US011828118B2

(12) United States Patent
Elkawass

(10) Patent No.: US 11,828,118 B2
(45) Date of Patent: Nov. 28, 2023

(54) METHOD AND SYSTEM FOR MULTILATERAL QUICK ACCESS IN OIL AND GAS INDUSTRY

(71) Applicant: SAUDI ARABIAN OIL COMPANY, Dhahran (SA)

(72) Inventor: Amir Abdelhamid Mohammed Elkawass, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/702,546

(22) Filed: Mar. 23, 2022

(65) Prior Publication Data

US 2023/0304369 A1 Sep. 28, 2023

(51) Int. Cl.

| | |
|---|---|
| ***E21B 23/02*** | (2006.01) |
| ***E21B 7/06*** | (2006.01) |
| ***E21B 47/09*** | (2012.01) |
| ***E21B 47/00*** | (2012.01) |

(52) U.S. Cl.

CPC ..... *E21B 23/02* (2013.01); *E21B 7/061* (2013.01); *E21B 47/00* (2013.01); *E21B 47/09* (2013.01)

(58) Field of Classification Search

CPC ..... E21B 7/061; E21B 17/08; E21B 23/0418; E21B 29/06; E21B 47/09; E21B 47/092–098

See application file for complete search history.

(56) References Cited

U.S. PATENT DOCUMENTS

| | | | | |
|---|---|---|---|---|
| 3,122,213 | A * | 2/1964 | Hawk | E21B 47/024 175/45 |
| 5,579,829 | A | 12/1996 | Comeau et al. | |
| 5,996,711 | A | 12/1999 | Ohmer | |
| 6,279,659 | B1 | 8/2001 | Brunet | |
| 10,246,987 | B2 | 4/2019 | Gosney | |
| 2014/0262528 | A1 * | 9/2014 | Desai | E21B 7/061 175/73 |

(Continued)

OTHER PUBLICATIONS

"Rapid Multilateral Systems—Well Completions;" Retrieved from the Internet: URL: <https://www.slb.com/completions/well-completions/multilaterals> (8 pages).

(Continued)

*Primary Examiner* — Robert E Fuller
*Assistant Examiner* — Lamia Quaim
(74) *Attorney, Agent, or Firm* — Osha Bergman Watanabe & Burton LLP

(57) ABSTRACT

A system includes a quick access casing coupling, a drill string, a whipstock, a lateral entry locator, a logging tool, and a drill bit. The quick access casing coupling has an inner profile and is installed on a tubular body. The whipstock has a whip face and is removably connected to the drill string. The lateral entry locator is connected to the whipstock and includes an outer surface designed to engage with the inner profile of the quick access casing coupling. Engagement of the outer surface and the inner profile orients the whip face towards a planned location of a lateral. The drill bit is connected to the drill string and is configured to kick off from the whip face into a portion of the circumferential wall adjacent to the planned location to drill the lateral.

20 Claims, 7 Drawing Sheets

(56) References Cited

U.S. PATENT DOCUMENTS

2018/0274316 A1* 9/2018 Dancer ..... E21B 47/12
2018/0313156 A1* 11/2018 Steele ..... E21B 23/01

OTHER PUBLICATIONS

"Multilateral drilling & completion technology based on Solid Expandable Tubular Fixing System," Retrieved from the Internet: URL: <https://www.researchgate.net/publication/240447180_Multilateral_drilling_completion_technology_based_on_Solid_Expandable_Tubular_fixing_system> (8 pages).
"Digitalization in Oil & Gas Industry—4IR & IIOT | Aramco;" Retrieved from the Internet: URL: <https://www.aramco.com/en/creating-value/technology development/in-house-developed-technologies/digitalization> (9 pages).

* cited by examiner

METHOD AND SYSTEM FOR MULTILATERAL QUICK ACCESS IN OIL AND GAS INDUSTRY

BACKGROUND

In the oil and gas industry, hydrocarbons are located in porous formations far beneath the Earth's surface. Wells are drilled into these formations to produce the hydrocarbons. There may be more than one hydrocarbon formation located on top of one another. In this scenario, a singular wellbore may be drilled vertically through all of the hydrocarbon formations and each hydrocarbon formation may be selectively isolated and produced from during the life of the well.

In some scenarios, one or more of the hydrocarbon formations require the wellbore to be drilled laterally through the formation to efficiently produce from the formation. In such cases, the initial completion is designed based off of the deepest formation with the opportunity to re-enter the well and drill the shallower laterals to produce from the shallower formations in the future. This re-entry operation may be performed multiple times depending on the number of producible hydrocarbon formations through with the initial wellbore is drilled. When the well is re-entered and multiple laterals are drilled from the original wellbore, the well may be called a multilateral well.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments methods and systems for drilling a lateral for a well having a tubular body. The system includes a quick access casing coupling, a drill string, a whipstock, a lateral entry locator, a logging tool, and a drill bit. The quick access casing coupling has an inner profile and is installed on the tubular body. The tubular body is made of a circumferential wall defining a conduit and the tubular body traverses a planned location of the lateral. The drill string is deployed inside the conduit of the tubular body. The whipstock has a whip face and is removably connected to the drill string. The lateral entry locator is connected to the whipstock, downhole from the drill string, and includes an outer surface designed to engage with the inner profile of the quick access casing coupling. Engagement of the outer surface and the inner profile orients the whip face towards the planned location of the lateral. The logging tool is connected to the lateral entry locator and is configured to log the tubular body and detect the quick access casing coupling. The drill bit is connected to the drill string and is configured to kick off from the whip face into a portion of the circumferential wall adjacent to the planned location to drill the lateral.

The method includes installing a quick access casing coupling having an inner profile into the tubular body. The tubular body has a circumferential wall defining a conduit. The method also includes running a drill string, connected to a whipstock having a lateral entry locator and a logging tool, into the conduit of the tubular body and detecting the inner profile of the quick access casing coupling using the logging tool. The method further includes engaging an outer surface of the lateral entry locator with the inner profile of the quick access casing coupling to orientate a whip face of the whipstock towards a planned location of the lateral and drilling the lateral by kicking off a drill bit from the whip face into the circumferential wall of the tubular body adjacent to the planned location of the lateral.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1:
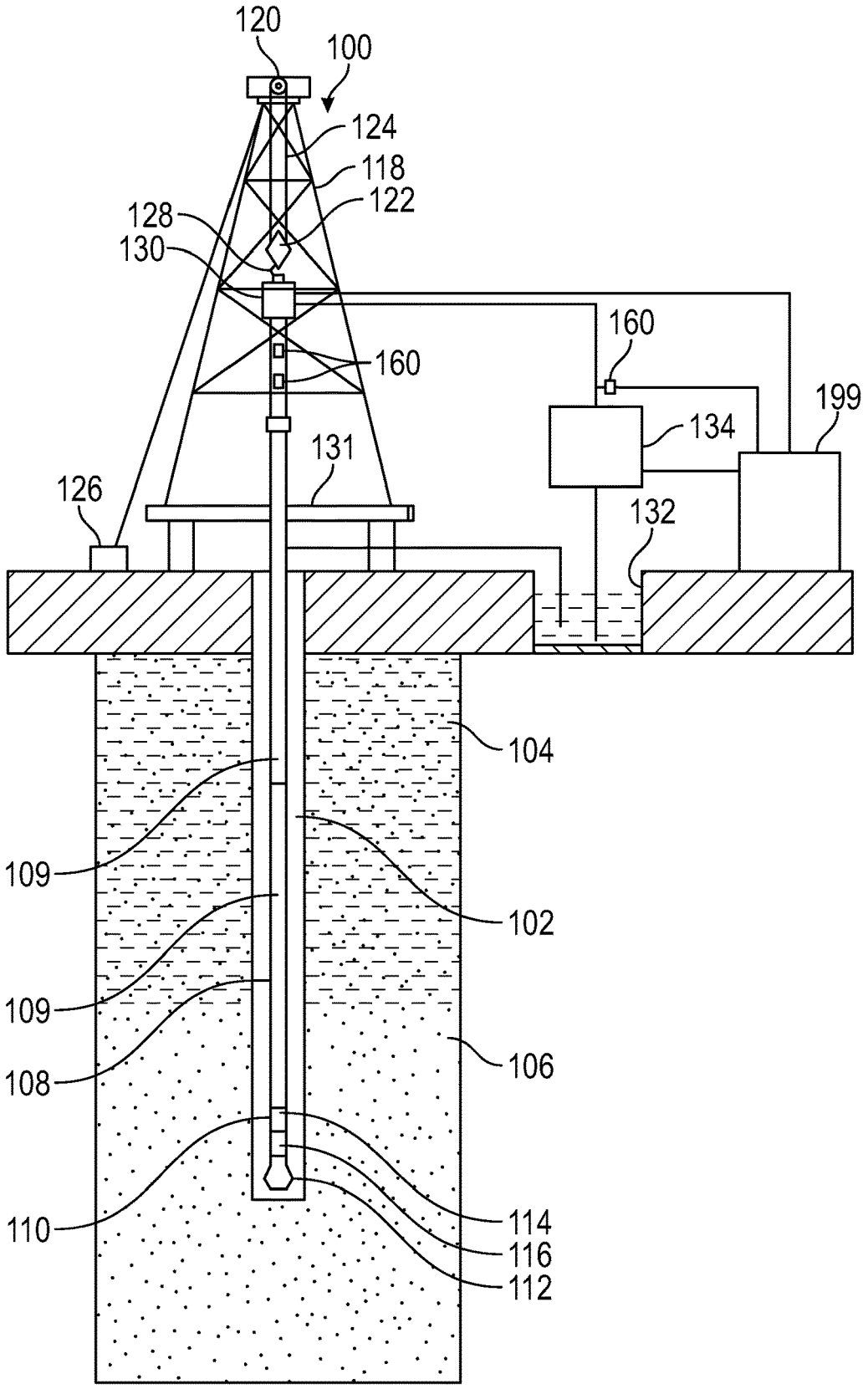
FIG. 1 shows an exemplary well site in accordance with one or more embodiments.

FIG. 1 shows an exemplary well site (100) in accordance with one or more embodiments. In general, well sites may be configured in a myriad of ways. Therefore, the well site (100) is not intended to be limiting with respect to the particular configuration of the drilling equipment. The well site (100) is depicted as being on land. In other examples, the well site (100) may be offshore, and drilling may be carried out with or without use of a marine riser. A drilling operation at well site (100) may include drilling a wellbore (102) into a subsurface including various formations (104, 106). For the purpose of drilling a new section of wellbore (102), a drill string (108) is suspended within the wellbore (102).

The drill string (108) may include one or more drill pipes (109) connected to form conduit and a bottom hole assembly (BHA) (110) disposed at the distal end of the conduit. The BHA (110) may include a drill bit (112) to cut into the subsurface rock. The BHA (110) may include measurement tools, such as a measurement-while-drilling (MWD) tool (114) and logging-while-drilling (LWD) tool 116. Measurement tools (114, 116) may include sensors and hardware to measure downhole drilling parameters, and these measurements may be transmitted to the surface using any suitable telemetry system known in the art. The BHA (110) and the drill string (108) may include other drilling tools known in the art but not specifically shown.

The drill string (108) may be suspended in wellbore (102) by a derrick (118). A crown block (120) may be mounted at the top of the derrick (118), and a traveling block (122) may hang down from the crown block (120) by means of a cable or drilling line (124). One end of the cable (124) may be connected to a drawworks (126), which is a reeling device that can be used to adjust the length of the cable (124) so that the traveling block (122) may move up or down the derrick (118).

The traveling block (122) may include a hook (128) on which a top drive (130) is supported. The top drive (130) is coupled to the top of the drill string (108) and is operable to rotate the drill string (108). Alternatively, the drill string (108) may be rotated by means of a rotary table (not shown) on the drilling floor (131). Drilling fluid (commonly called mud) may be stored in a mud pit (132), and at least one pump (134) may pump the mud from the mud pit (132) into the drill string (108). The mud may flow into the drill string (108) through appropriate flow paths in the top drive (130) (or a rotary swivel, if a rotary table is used instead of a top drive to rotate the drill string (108)).

In one implementation, a system (199) may be disposed at or communicate with the well site (100). System (199) may control at least a portion of a drilling operation at the well site (100) by providing controls to various components of the drilling operation. In one or more embodiments, system (199) may receive data from one or more sensors (160) arranged to measure controllable parameters of the drilling operation. As a non-limiting example, sensors (160) may be arranged to measure WOB (weight on bit), RPM (drill string rotational speed), GPM (flow rate of the mud pumps), and ROP (rate of penetration of the drilling operation).

Sensors (160) may be positioned to measure parameter(s) related to the rotation of the drill string (108), parameter(s) related to travel of the traveling block (122), which may be used to determine ROP of the drilling operation, and parameter(s) related to flow rate of the pump (134). For illustration purposes, sensors (160) are shown on drill string (108) and proximate mud pump (134). The illustrated locations of sensors (160) are not intended to be limiting, and sensors (160) could be disposed wherever drilling parameters need to be measured. Moreover, there may be many more sensors (160) than shown in FIG. 1 to measure various other parameters of the drilling operation. Each sensor (160) may be configured to measure a desired physical stimulus.

During a drilling operation at the well site (100), the drill string (108) is rotated relative to the wellbore (102), and weight is applied to the drill bit (112) to enable the drill bit (112) to break rock as the drill string (108) is rotated. In some cases, the drill bit (112) may be rotated independently with a drilling motor. In further embodiments, the drill bit (112) may be rotated using a combination of the drilling motor and the top drive (130) (or a rotary swivel if a rotary table is used instead of a top drive to rotate the drill string (108)).

While cutting rock with the drill bit (112), mud is pumped into the drill string (108). The mud flows down the drill string (108) and exits into the bottom of the wellbore (102) through nozzles in the drill bit (112). The mud in the wellbore (102) then flows back up to the surface in an annular space between the drill string (108) and the wellbore (102) with entrained cuttings. The mud with the cuttings is returned to the pit (132) to be circulated back again into the drill string (108). Typically, the cuttings are removed from the mud, and the mud is reconditioned as necessary, before pumping the mud again into the drill string (108). In one or more embodiments, the drilling operation may be controlled by the system (199).

In multilateral wells, a main wellbore is drilled and completed with the purpose of re-entry to the well to drill shallower laterals from the main wellbore. Often, these main wellbores are drilled and completed with no reference made to the future laterals, thus, access to these laterals is only possible by using lateral finding tools. However, lateral finding tools are often limited in application and are impractical to use. As such, embodiments disclosed herein present systems and methods that may be used to easily access and drill the laterals of a multi-lateral well.

Figure 2B:
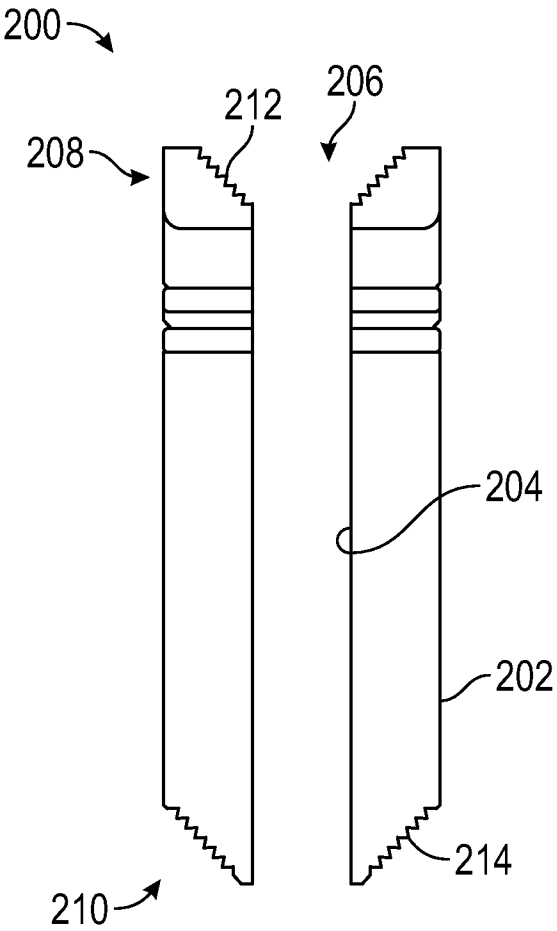
FIGS. 2*a* and 2*b* show a quick access casing coupling (QAC) in accordance with one or more embodiments.
Figure 2A:
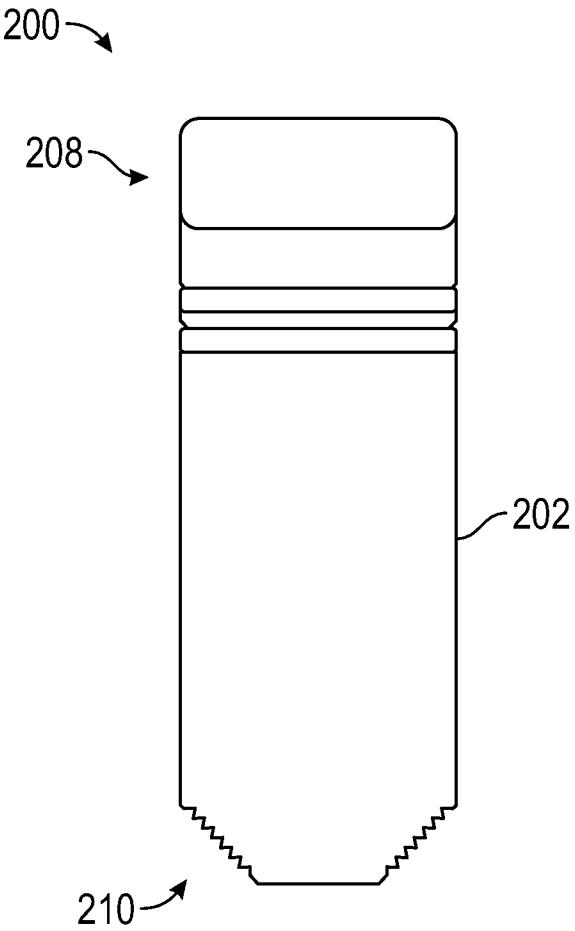

FIGS. 2*a* and 2*b* show a quick access casing coupling (QAC) (200) in accordance with one or more embodiments. Specifically, FIG. 2*a* shows an external view of the QAC (200) and FIG. 2*b* shows a cross section of the QAC (200). The QAC (200) has a cylindrical body (202) with an inner profile (204) defining a conduit (206). The cylindrical body (202) may be made out of a material that is designed to handle downhole or harsh conditions, such as a steel alloy. The inner profile (204) may be smooth as shown in FIGS. 2*a* and 2*b*, or the inner profile (204) may be machined with various profiles and crevices such that the inner profile (204) may mate with a separate tool (not pictured).

The conduit (206) extends from a box end (208) to a pin end (210) of the QAC (200). The box end (208) has internal threads (212), and the pin end (210) has external threads (214). The internal threads (212) and the external threads (214) may be any threads known in the art such as buttress threads, box threads, etc. The external threads (214) and the internal threads (212) may mate with corresponding threads on a separate tubular body in order to install the QAC (200) as part of the separate tubular body. As such, FIG. 3 shows the QAC (200) installed as part of a separate tubular body traversing a planned location of a lateral in accordance with one or more embodiments.

Figure 3:
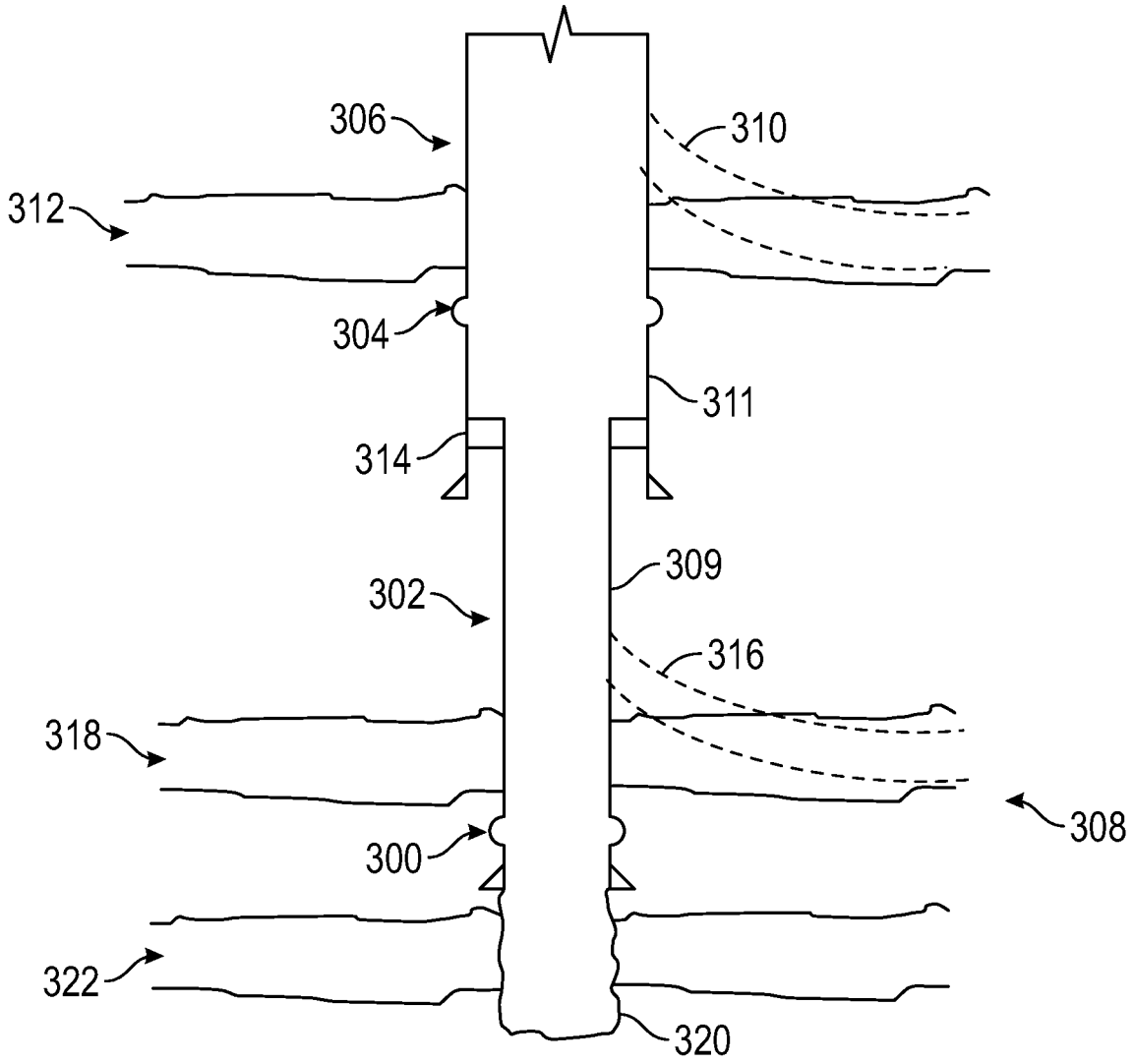
FIG. 3 shows the QAC installed as part of a separate tubular body traversing a planned location of a lateral in accordance with one or more embodiments.

Specifically, FIG. 3 shows a first QAC (300) installed as part of a liner (302) and a second QAC (304) installed as part of a casing string (306). In accordance with one or more embodiments, the QACs (200) are installed as part of the casing string (306) and the liner (302) using the box end (208) and the pin end (210) as described in FIGS. 2*a* and 2*b*. The casing string (306) and the liner (302) are cemented within a well (308) located in the surface of the Earth. The liner (302) is made out of a first circumferential wall (309) that defines a portion of the conduit (206) that extends from the first QAC (300). The casing string (306) is made out of a second circumferential wall (311) that defines a portion of the conduit (206) that extends from second QAC (304). The casing string (306) and the liner (302) may be made out of any durable material, such as steel alloy, and may be any size known in the art.

The casing string (306) extends from a surface location (not pictured) to a first depth located within the surface of the Earth. The casing string (306) traverses a planned location of a second planned lateral (310). The second planned lateral (310) may be drilled to produce from a third hydrocarbon reservoir (312). The liner (302) is hung from the inside of the casing string (306) using a liner hanger (314). The liner hanger (314) may be any liner hanger known in the art such as a mechanical or hydraulic liner hanger. The liner (302) extends to a second depth within the surface of the Earth. The liner (302) traverses a planned location of a first planned lateral (316). The first planned lateral (316) may be drilled to produce from a second hydrocarbon reservoir (318).

A primary bore (320), drilled into the surface of the Earth, extends to a third depth. In accordance with one or more embodiments, the second depth is deeper (i.e., located further downhole) than the first depth and the third depth is deeper than the second depth. The primary bore (320) may be intersecting and designed to produce from a first hydrocarbon reservoir (322). The primary bore (320) is shown having a barefoot completion; however, the primary bore (320) may have any completion known in the art without departing from the scope of the disclosure herein. Further, the primary bore (320) is shown as a vertical wellbore; however, the primary bore (320) may be an inclined or lateral wellbore.

Upon depletion, physical or economic, of the first hydrocarbon reservoir (322) using the primary bore (320), the well (308) may be re-entered to drill the first planned lateral (316) using the first QAC (300). The second hydrocarbon reservoir (318) may then be produced from using the first planned lateral (316). Upon depletion of the second hydrocarbon reservoir (318), the well (308) may be re-entered to drill the second planned lateral (310) using the second QAC (304). The third hydrocarbon reservoir (312) may then be produced from using the second planned lateral (310). The specific well design outlined in FIG. 3 is for illustrative purposes only, and the present disclosure intends to encompass any QAC (200) installed on any tubular body traversing a planned location of a lateral.

Figure 4:
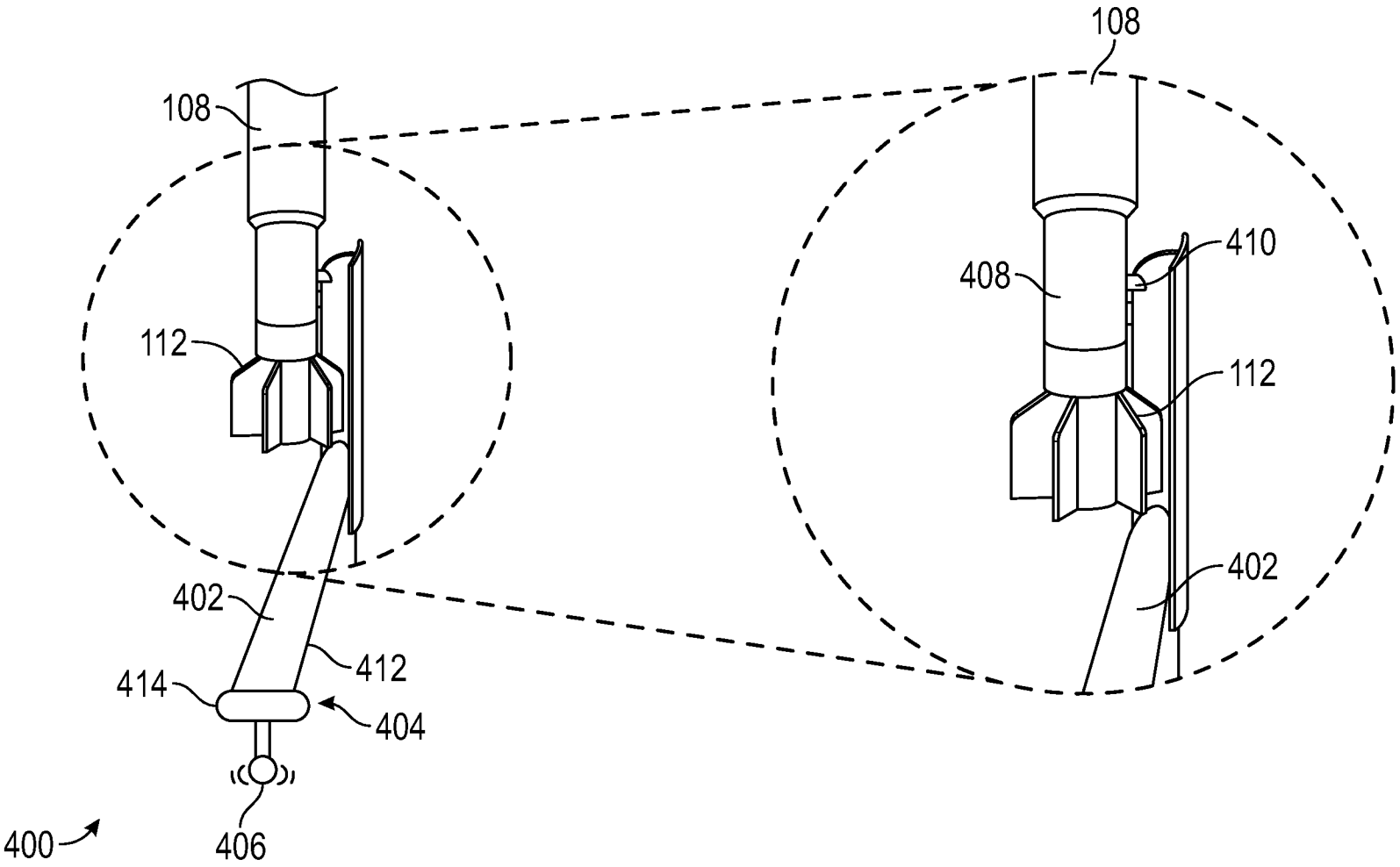
FIG. 4 shows a downhole tool system (400) in accordance with one or more embodiments.

FIG. 4 shows a downhole tool system (400) in accordance with one or more embodiments. The downhole tool system (400) is made out of a drill string (108), a drill bit (112), a whipstock (402), a lateral entry locator (LEL) (404), and a logging tool (406). The drill string (108) is connected to the drill bit (112) and the whipstock (402). In accordance with one or more embodiments, the whipstock (402) is connected to a drill sub (408) of the drill string (108). A drill sub (408) is a tubular that is part of the drill string (108). For the embodiments shown in FIG. 4, the drill sub (408) connects the drill bit (112) to the rest of the drill string (108). However, the whipstock (402) may be connected to any portion of the drill string (108), such as the drill bit (112), without departing from the scope of the disclosure herein.

The whipstock (402) is removably connected to the drill string (108) using one or more shear pins (410). The shear pins (410) are designed to shear when a pre-determined force is applied to the shear pins (410). As such, the whipstock (402) is able to be parted from the drill string (108) by shearing the shear pins (410). The whipstock (402) is a ramp that has a whip face (412) defined by the sloped side of the ramp. The whipstock (402) may be made out of any durable material known in the art, such as a steel alloy. The whipstock (402) may be a retrievable whipstock that may be retrieved by a separate downhole tool, or the whipstock (402) may be a permanent whipstock that may be cemented in place within the conduit (206).

The LEL (404) is connected to the whipstock (402) downhole from the end of the whipstock (402) connected to the drill string (108). The LEL (404) includes an outer surface (414) that is designed to engage with the inner profile (204) of the QAC (200). As the outer surface (414) of the LEL (404) engages with the inner profile (204) of the QAC (200), the downhole tool system (400) rotates to orient the whip face (412) to a pre-determined direction. The logging tool (406) is connected to the end of the LEL (404) opposite the whipstock (402). The logging tool (406) may be any logging tool known in the art such as a gyroscope, an ultrasonic logging tool, and a measurement while drilling (MWD) tool. The logging tool (406) may be used to detect the location of the QAC (200).

Figure 5A:
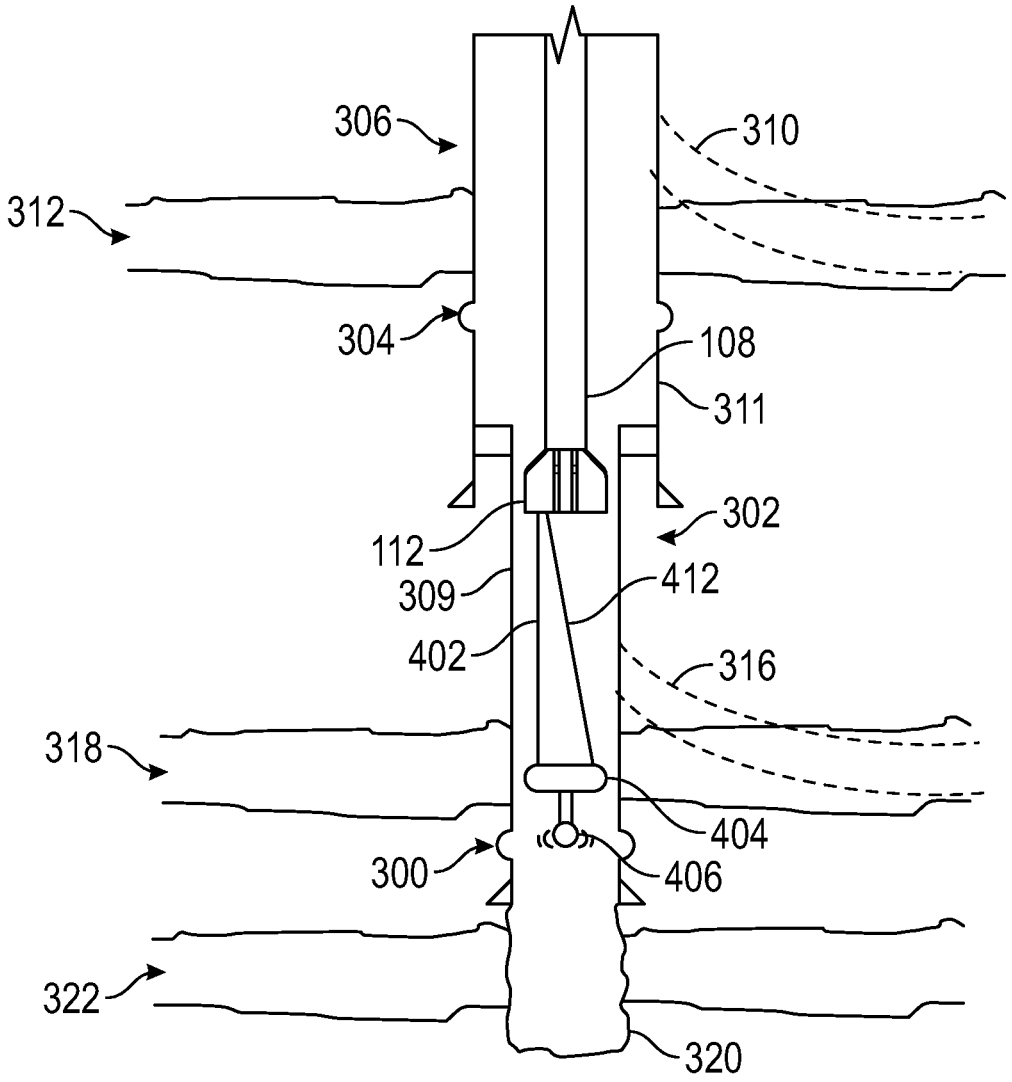
FIGS. 5*a* and 5*b* show the downhole tool system (400) deployed in a well (308) in accordance with one or more embodiments.
Figure 5B:
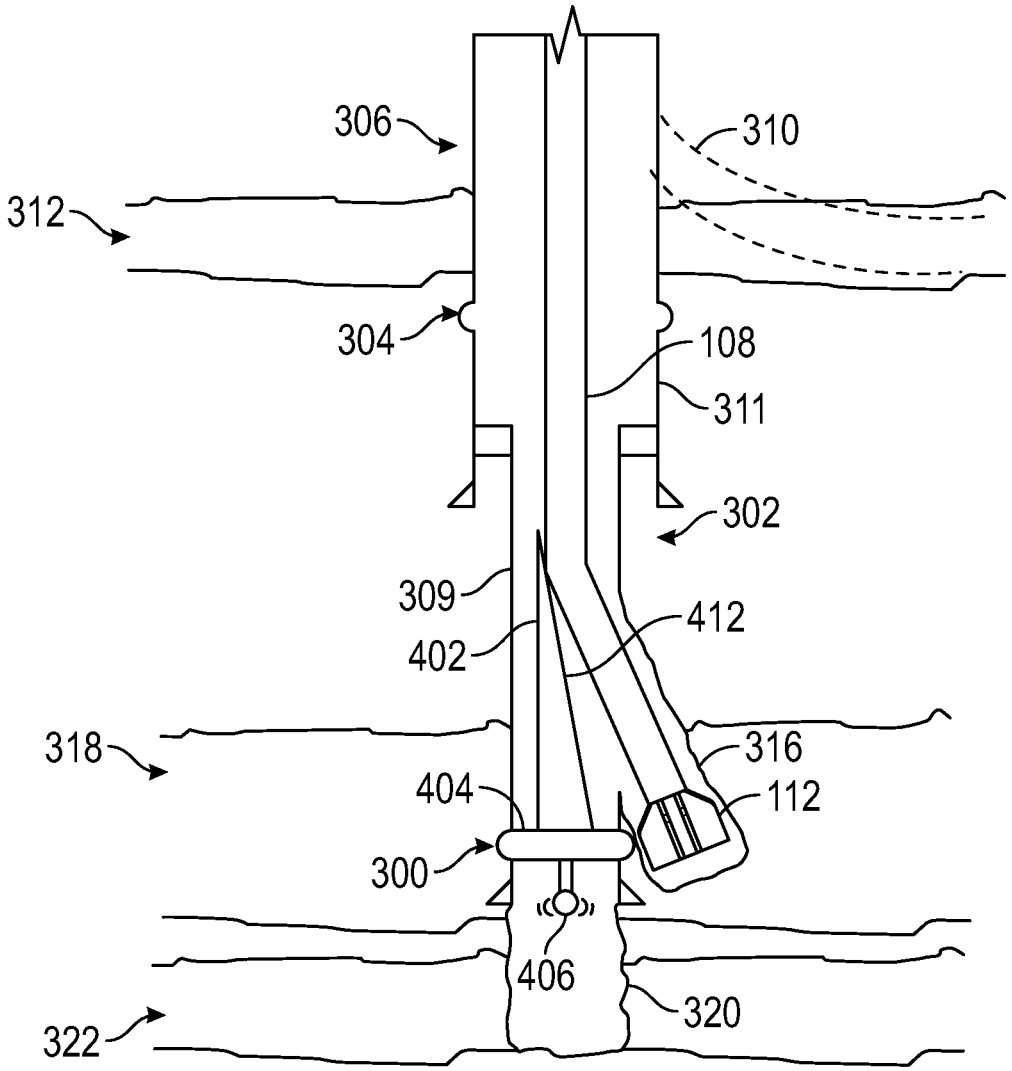

FIGS. 5*a* and 5*b* show the downhole tool system (400) deployed in a well (308) in accordance with one or more embodiments. Components shown in FIGS. 5*a* and 5*b* that are similar to or the same as components shown in FIGS. 1-4 have not been redescribed for purposes of readability and have the same description and function as outlined above. Specifically, FIG. 5*a* shows the drill string (108), attached to the drill bit (112), whipstock (402), LEL (404), and logging tool (406), deployed in the conduit (206) of a casing string (306) and a liner (302).

The logging tool (406) logs the casing string (306) and liner (302) as the drill string (108) is being lowered into the well (308). The readings from the logging tool (406) may be sent to a computer at the surface using wired drill pipe (i.e., drill pipe that has been fit with inductive coils and a cable capable of data transmission) installed as part of the drill string (108). Through logging the casing string (306) and the liner (302), the logging tool (406) is able to detect the location of the QACs (200).

When the logging tool (406) detects the location of the first QAC (300), the LEL (404) may be lowered to the correct depth to engage the outer surface (414) of the LEL (404) with the inner profile (204) of the first QAC (300). As the LEL (404) engages with the first QAC (300), the whip face (412) is oriented towards the planned location of the first planned lateral (316). As such, FIG. 5*b* shows the LEL (404) engaged with the first QAC (300) with the drill bit (112) in the process of drilling the first planned lateral (316).

When the LEL (404) engages with the first QAC (300), a weight may be applied to the drill string (108) to shear the shear pin(s) (410) and detach the whipstock (402) from the drill string (108). With the whipstock (402) detached from the drill string (108), the drill bit (112) uses the whip face (412) to kick off into a portion of the first circumferential wall (309) adjacent to the planned location to drill the first planned lateral (316). The drill bit (112) may mill a window through the first circumferential wall (309) to access rock and drill a new wellbore that will become the first planned lateral (316).

Figure 6:
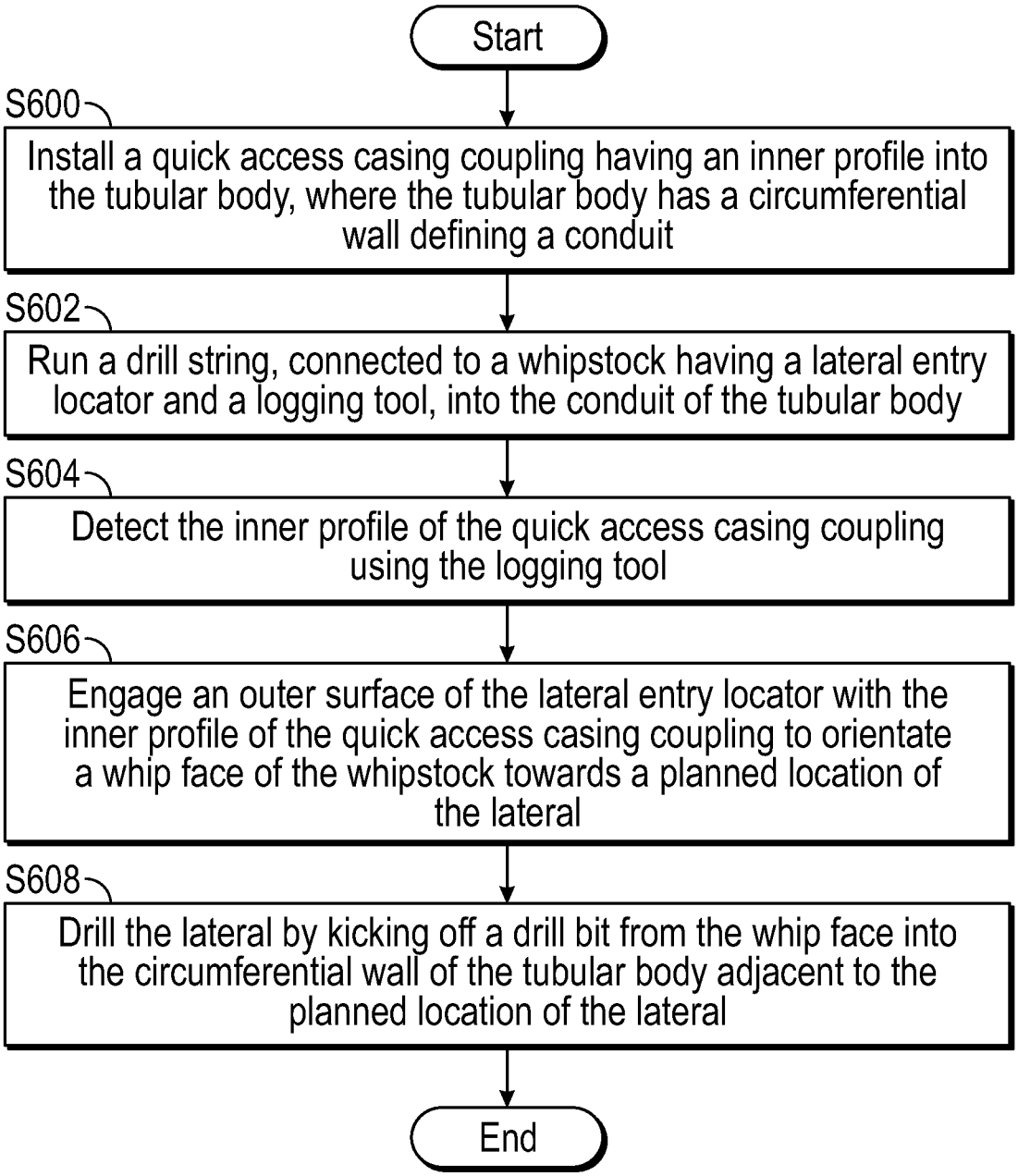
FIG. 6 shows a flowchart in accordance with one or more embodiments.

FIG. 6 shows a flowchart in accordance with one or more embodiments. The flowchart outlines a method for drilling a lateral for a well (308) having a tubular body. While the various blocks in FIG. 4 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially, a QAC (200) having an inner profile (204) is installed into the tubular body, where the tubular body has a circumferential wall defining a conduit (206) (S600). The QAC (200) is installed at a depth along the tubular body downhole from the location of the planned lateral. The tubular body may be any tubular body that would be located in a well (308) such as a casing string (306), a liner (302), etc. The QAC (200) may be threaded into the tubular body using a pin end (210)/box end (208) connection. In accordance with one or more embodiments, a first QAC (300) is installed as part of a liner (302) traversing a first planned lateral (316) and a second QAC (304) is installed as part of a casing string (306) traversing a second planned lateral (310).

A drill string (108), connected to a whipstock (402) having a LEL (404) and a logging tool (406), is run into the conduit (206) of the tubular body (S602). The whipstock (402) is removably connected to the drill string (108) by one or more shear pins (410). The LEL (404) is connected to the whipstock (402) downhole from the drill string (108) and the logging tool (406) is connected to the LEL (404) downhole from the whipstock (402). The logging tool (406) may be any logging tool known in the art such as a gyroscope, an ultrasonic logging tool, or a MWD tool.

The inner profile (204) of the QAC (200) is detected using the logging tool (406) (S604). The readings taken by the logging tool (406) may be read at a computer at the surface to determine the depth of the QAC (200). Upon detection of the QAC (200), an outer surface (414) of the LEL (404) is engaged with the inner profile (204) of the QAC (200) to orientate a whip face (412) of the whipstock (402) towards a planned location of the lateral (S606). Upon engagement of the QAC (200) and the LEL (404), a weight may be applied to the drill string (108) to shear the shear pin(s) (410) and detach the whipstock (402) from the drill string (108). The lateral is drilled by kicking off a drill bit (112) from the whip face (412) into the circumferential wall of the tubular body adjacent to the planned location of the lateral (S608).

In accordance with one or more embodiments, the well (308) has a primary bore (320), a first planned lateral (316), and a second planned lateral (310). The primary bore (320) is used to produce the first hydrocarbon reservoir (322) until the first hydrocarbon reservoir (322) is no longer economically viable. A first cement plug (not pictured) may be placed in the well (308) downhole form the first planned lateral (316) yet up hole from the primary bore (320). The first cement plug isolates the primary bore (320) from the first planned lateral (316).

The downhole tool system (400) is run into the well (308). The logging tool (406) is used to detect the location of the first QAC (300) and the LEL (404) engages with the first QAC (300) to orient the whip face (412) towards the first planned lateral (316). The whipstock (402) is detached from the drill string (108) by shearing the shear pin(s) (410). The first planned lateral (316) is drilled by kicking the drill bit (112) off of the whip face (412) into the first circumferential wall (309). The whipstock (402) is either removed from the well (308) using a separate downhole tool or the whipstock (402) is cemented in place within the well (308). The first planned lateral (316) is used to produce from the second hydrocarbon reservoir (318) until the second hydrocarbon reservoir (318) is no longer economically viable.

A second cement plug (not pictured) may be placed in the well (308) downhole from the second planned lateral (310) yet up hole from the first planned lateral (316). The downhole tool system (400) is run into the well (308). The logging tool (406) detects the location of the second QAC (304) and the LEL (404) is engaged with the second QAC (304) to orient the whip face (412) towards the second planned lateral (310). The second planned lateral (310) is drilled by kicking the drill bit (112) off of the whip face (412) into the second circumferential wall (311). The whipstock (402) is either removed from the well (308) using a separate downhole tool or the whipstock (402) is cemented in place within the well (308). The second planned lateral (310) is used to produce from the third hydrocarbon reservoir (312).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed:

1. A system for drilling a lateral for a well having a tubular body, the system comprising:

a quick access casing coupling, comprising an inner profile, installed on the tubular body, wherein the tubular body is made of a circumferential wall defining a conduit and the tubular body traverses a planned location of the lateral;

a drill string deployed inside the conduit of the tubular body;

a whipstock, having a whip face, removably connected to the drill string;

a lateral entry locator connected to the whipstock downhole from the drill string, the lateral entry locator comprising an outer surface designed to engage with the inner profile of the quick access casing coupling, wherein engagement of the outer surface and the inner profile orients the whip face towards the planned location of the lateral;

a logging tool, connected downhole from the lateral entry locator, configured to log the tubular body and detect the quick access casing coupling prior to interaction between the lateral entry locator and the quick access casing coupling; and a drill bit connected to the drill string, wherein the drill bit is configured to kick off from the whip face into a portion of the circumferential wall adjacent to the planned location to drill the lateral.

2. The system of claim 1, wherein the quick access casing coupling is installed on the tubular body downhole from the planned location of the lateral.

3. The system of claim 1, wherein the quick access casing coupling further comprises a pin end and a box end.

4. The system of claim 3, wherein the quick access casing coupling is installed in the tubular body using the pin end and the box end.

5. The system of claim 1, wherein the whipstock is removably connected to the drill string using a shear pin.

6. The system of claim 1, wherein the logging tool comprises one or more tools from a list comprising: a gyroscope, an ultrasonic logging tool, and a measurement while drilling tool.

7. The system of claim 1, wherein the well comprises a primary bore located downhole from the tubular body.

8. The system of claim 1, wherein the tubular body comprises a liner having a first circumferential wall and a casing string comprising a second circumferential wall.

9. The system of claim 8, wherein the quick access casing coupling further comprises a first quick access casing coupling installed on the liner and a second quick access casing coupling installed on the casing string.

10. The system of claim 9, wherein the lateral comprises a first lateral drilled by engaging the lateral entry locator with the first quick access casing coupling and a second lateral drilled by engaging the lateral entry locator with the second quick access casing coupling.

11. A method for drilling a lateral in a well having a tubular body, the method comprising:

installing a quick access casing coupling having an inner profile into the tubular body, wherein the tubular body has a circumferential wall defining a conduit;

running a drill string, connected to a whipstock having a lateral entry locator and a logging tool, into the conduit of the tubular body, wherein the logging tool is located downhole from the lateral entry locator;

detecting the inner profile of the quick access casing coupling using the logging tool;

engaging an outer surface of the lateral entry locator with the inner profile of the quick access casing coupling after detection of the quick access coupling using the logging tool to orientate a whip face of the whipstock towards a planned location of the lateral; and drilling the lateral by kicking off a drill bit from the whip face into the circumferential wall of the tubular body adjacent to the planned location of the lateral.

12. The method of claim 11, wherein installing the quick access casing coupling into the tubular body further comprises installing the quick access casing coupling at a depth located downhole from the planned location of the lateral.

13. The method of claim 11, wherein installing the quick access casing coupling into the tubular body further comprises threading the quick access casing coupling into the tubular body using a pin end and a box end.

14. The method of claim 11, wherein drilling the lateral further comprises shearing a shear pin connecting the whipstock to the drill string.

15. The method of claim 11, wherein drilling the lateral further comprises milling a window into the circumferential wall of the tubular body using the drill bit.

16. The method of claim 11, wherein the tubular body further comprises a liner and a casing string.

17. The method of claim 16, wherein installing the quick access casing coupling further comprises installing a first quick access casing coupling into the liner and installing a second quick access casing coupling into the casing string.

18. The method of claim 17, wherein drilling the lateral further comprises drilling a first lateral and drilling a second lateral.

19. The method of claim 18, wherein drilling the first lateral further comprises engaging the lateral entry locator with the first quick access casing coupling.

20. The method of claim 18, wherein drilling the second lateral further comprises engaging the lateral entry locator with the second quick access casing coupling.

* * * * *